United States Patent [19]

Levy

[11] Patent Number: 4,973,088

[45] Date of Patent: Nov. 27, 1990

[54] CHANGEABLE LABELLING SYSTEM FOR RECORDING MEDIA STRUCTURES

[76] Inventor: Hyim J. Levy, 1341 11th St., Manhattan Beach, Calif. 90266

[21] Appl. No.: 406,215

[22] Filed: Sep. 12, 1989

[51] Int. Cl.[5] ..... B42D 15/00

[52] U.S. Cl. ..... 283/81; 206/387; 428/42

[58] Field of Search ..... 283/81; 428/40, 41, 428/42; 206/387

[56] References Cited

U.S. PATENT DOCUMENTS

| | | | |
|---|---|---|---|
| 3,508,754 | 4/1970 | Shorin | 283/81 |
| 4,355,824 | 10/1982 | Weber et al. | 283/81 |
| 4,507,883 | 4/1985 | Tarrant . | |
| 4,583,765 | 4/1986 | Messinger . | |
| 4,589,685 | 5/1986 | Lazar . | |
| 4,619,858 | 10/1986 | Dam et al. . | |
| 4,621,442 | 11/1986 | Mack . | |
| 4,621,837 | 11/1986 | Mack . | |
| 4,696,706 | 9/1987 | Griffin et al. | 428/42 |
| 4,708,285 | 11/1987 | Segall . | |
| 4,757,901 | 7/1988 | Woods . | |

*Primary Examiner*—Paul A. Bell
*Assistant Examiner*—Hwei-Siu Payer
*Attorney, Agent, or Firm*—Skjerven, Morrill, MacPherson, Franklin & Friel

[57] ABSTRACT

A changeable labelling system comprising a plurality of stacked paper labels, each label having its undersurface adhesively secured to an identical underlying label by a low adhesion substance to enable a top label to be easily peeled off and discarded when a new label is desired. The bottom label is affixed to a recording medium structure by a high adhesion substance.

19 Claims, 1 Drawing Sheet

CHANGEABLE LABELLING SYSTEM FOR RECORDING MEDIA STRUCTURES

FIELD OF THE INVENTION

This invention relates to labelling systems and in particular to a changeable labelling system for diskettes, cassettes, and other recording media structures which require securely affixed labels.

BACKGROUND OF THE INVENTION

Computer diskettes, such as floppy diskettes and microdiskettes, and videocassettes are examples of recording media which typically have the information recorded on them changed from time to time. For these media, a changeable labelling system is very convenient to identify the current contents of the recording media.

Most typically, a single paper adhesive strip is secured to the diskette or to the cassette so that the contents can be manually written on the label to be readily identified. When the diskette or cassette is erased and new information is recorded, the writing on the single label must be crossed out or erased and the current contents written on the label.

Alternatively, a new blank paper strip is applied over the existing strip. In using this prior art labelling system, the user must first locate the stock of separate paper strips and expend an inconvenient amount of time to apply this fresh label. Further, after a few relabellings, the labels become thick and unsightly, eventually forcing the user to either remove the old (and now well-adhered) labels, throw the recording medium structure away, or tolerate the growing stack of irregularly placed labels.

One prior art labelling system which overcomes the above-mentioned drawbacks with standard paper labels is described in U.S. Pat. No. 4,757,901 to Woods. In '901, an 37 adhesive polyester film label is affixed to a diskette or cassette, and a dry-erase marker pen is used for writing onto the label. An eraser is provided to erase the indicia on the label. A drawback to the '901 invention is that the user must locate the dry-erase marker pen and the eraser in order to change the indicia on the label.

Another prior art labelling system which attempts to provide a convenient changeable labelling system is described in U.S. Pat. No. 4,589,685 to Lazar. In this prior art system, a "magic slate" type labelling system is used, wherein a waxed impression surface adhesively secured to a diskette or cassette has an overlying translucent sheet. Labelling is accomplished by writing on the surface of the translucent sheet with a blunt instrument. The selective sticking of the translucent sheet to the impression surface due to the pressure of the blunt instrument creates a visible image through the translucent sheet. Erasure is accomplished by lifting the translucent sheet from the impression surface. A drawback of this prior art system is that the labelling system is relatively expensive and requires a relatively thick labelling structure, precluding affixing this type of labelling structure to the face of a diskette or cassette where the diskette or cassette must fit through a narrow insertion slot. Furthermore, this system provides a freely moving plastic sheet which may catch on or damage the mechanism into which it is placed.

What would be desirable is an inexpensive changeable labelling system, wherein no special writing or erasing materials are required, and where the mechanical integrity and thickness of the labelling system does not preclude its usage on the face of diskettes, videocassette, audio cassettes and the like.

SUMMARY OF THE INVENTION

In this invention, the above problems and difficulties of prior art changeable labelling systems have been overcome by a changeable labelling system comprising a plurality of stacked paper labels, each label having its undersurface adhesively secured to an underlying label by a low adhesion substance to enable a top label to be easily peeled off and discarded when a new label is desired. In one embodiment, the bottom label is affixed to a diskette or cassette by a high adhesion substance.

By coating the entire bottom surface of each of the stacked labels with a low adhesion substance, the corners of the labels are prevented from rising even after frequent contact of the label stack with a housing surrounding an insertion opening into which the diskette or cassette is inserted. The top label may be then removed with a fingernail or other sharp object.

In one embodiment, the stacked labels have one or more edges which are staggered in a step-like fashion so that a top label may be more easily removed. This embodiment also ensures that when the diskette or cassette is slid into an insertion opening, the periphery of the insertion opening coming in contact with a staggered edge of the label stack will simply slide over the stack without damage to the labels. This embodiment also allows the inclusion of a greater number of labels while maintaining visual and functional integrity.

DETAILED DESCRIPTION

Figure 1:
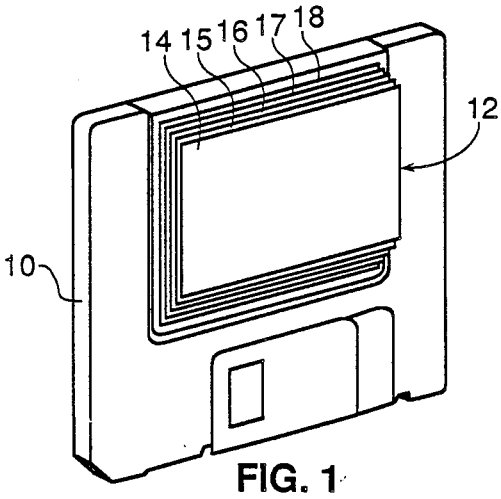
FIG. 1 shows a preferred embodiment of the invention being used on a diskette.

Shown in FIG. 1 is a microdiskette having a protective cover 10 incorporating changeable labelling system 12. Labelling system 12 comprises a plurality of individual labels 14, 15, 16, 17 of rectangular shape; however, the labelling system may comprise more or less labels. In a similar embodiment, the labels have rounded corners to reduce the likelihood of inadvertent lifting of the corners. Labels 14–17 are made from paper or a similar material easily written upon by common writing instruments. The labels 14–17 are stacked and adhered to one another by a low adhesive substance so that a top label such as top label 14, may be easily peeled from the stack without any tearing of the label underlying the top label. Bottom label 18 is permanently affixed, or affixed so as not to be as easily removable as labels 14–17, to protective cover 10 by any of various well known high adhesive substances. In a preferred embodiment, bottom label 18 may be removed without leaving residue on the underlying recording medium structure.

One type of low adhesive substance which may be applied to the undersides of stacked labels 14–17 is the adhesive type 72-9539, available in liquid form from National Starch and Chemical Corporation, Finderne Avenue, Bridgewater, N.J. This particular adhesive provides excellent removability from paper surfaces, low peel adhesion and good shear adhesion. This adhesive, or any equivalent adhesive well known to those skilled in the art, may be applied to the undersides of the labels using a Meyer (wire rod) coater, a reverse roll coater, a Dahlgren coater, or any other well known type coater suitable for this particular application.

As an alternative to coating each label with a low adhesive substance, each paper label may have adhered to its underside a double coated adhesive tape, such as tape number Y9415, available from 3M Company, St. Paul, Minn.

In a preferred embodiment, shown in FIG. 1, the labels 14–17 are staggered, with the height and/or width dimension of the labels being progressively reduced toward the top of the stack, to enable the top label to be easily separated and lifted off the stack. Any number of edges (zero to four) may be staggered while still achieving the advantages of the invention.

For microdiskettes, which are approximately 3.5 x 3.5 in., labels having dimensions of 2.75 in. wide by 2.0 in. in height are recommended so as to not interfere with the mechanism of the microdiskette. In one embodiment, between four and eight labels are stacked to provide a sufficient number of label changes without causing the stack to be so high as to interfere with the diskettes' insertion into a housing.

In one embodiment of labels which are intended to be used on a 5¼ in. x ¼ in. floppy diskette, each label is approximately 3 in. wide by 1 in. in height.

For audio cassettes, the dimensions of the preferred labels are approximately 3.5 in. wide by 0.6 in. in height.

For compact discs, the shape of the preferred labels are circular, having a radius between approximately 0.4 in. to 2.25 in. Labels for the edge of a compact disc container have a preferred height dimension of approximately 0.25 in., with a width dimension of approximately 4.5 in.

Figure 2:
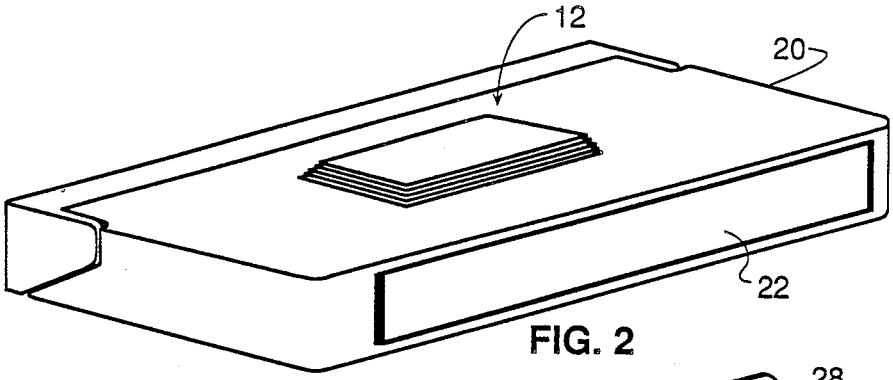
FIG. 2 shows a preferred embodiment of the invention being used on a videocassette.

FIG. 2 shows front labelling system 12 being used on a videocassette 20. The staggered labels 12 are similar to labels 14–18 in FIG. 1. Also shown in FIG. 2 are staggered edge labels 22. For videocassettes, the labels 12 may be made wider, up to 6 in., with heights up to 2 in. without interfering with the mechanism of the videocassette. Edge labels 22 for the cassette or its container may be up to 6 in. wide and 0.75 in. high with a variation in the width dimension for staggering of the labels.

Figure 3A:
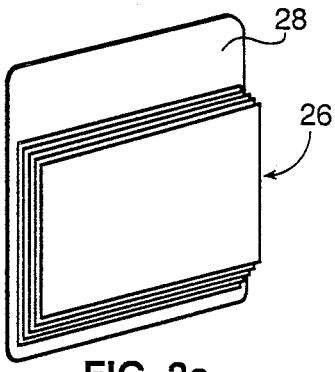
FIGS. 3*a* and 3 *b* show an alternative embodiment of the invention including a wrap around labelling portion.

FIG. 3*a* shows a labelling system 26 having labels, similar to labels 14–17 in FIG. 1, and having a bottom label 28 which may be used to wrap around an edge of a microdiskette, audio cassette videocassette, or compact disc container.

Figure 3B:
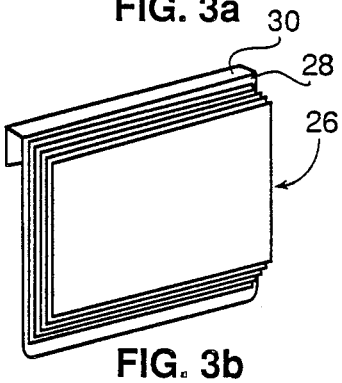

FIG. 3*b* shows the portion 30 of bottom label 28 which wraps around and adheres to an edge of a recording medium structure. Bottom label 28 or edge 30 may be color coded for identification purposes.

The labelling system of this invention may be used on a wide variety of types of recording media structures and, thus, its use is not necessarily limited to the above-described recording media structures.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A changeable labeling system comprising:

a first label adhesively secured to a recording medium structure; and a plurality of stacked labels positioned over said first label, each of said stacked labels being removably adhered to an underlying label, wherein said first label is adhesively secured to said recording medium structure by a first adhesive covering an entire surface area of a bottom surface of said first label, and each of said stacked labels are adhered to an underlying label by a second adhesive covering an entire surface area of a bottom surface of each of said stacked labels, said second adhesive enabling each of said stacked labels to be peeled off an underlying label without adversely affecting said underlying label, and wherein said stacked labels are positioned over said first label in a staggered fashion with one or more dimensions of each overlying label being smaller than corresponding dimensions of an underlying label.

2. The labelling system of claim 1 wherein said first label has a dimension larger than a corresponding dimension of said stacked labels for wrapping around and adhering to an edge of a recording medium structure.

3. The labelling system of claim 1 wherein said first adhesive provides a greater adhesion to said recording medium structure than said second adhesive provides between said stacked labels.

4. The labelling system of claim 1 wherein said recording medium structure comprises a floppy diskette.

5. The labelling system of claim 4 wherein dimensions of said first label and said stacked labels are between 2–4 in. in width and 0.5–1.5 in. in height.

6. The labelling system of claim 1 wherein said recording medium structure comprises a microdiskette.

7. The labelling system of claim 6 wherein dimensions of said first label and said stacked labels are between 1.5–3 in. in width and 0.5–2.5 in. in height.

8. The labelling system of claim 1 wherein said recording medium structure comprises a videocassette.

9. The labelling system of claim 8 wherein dimensions of said first label and said stacked labels are between 3–7 in. in width and 0.7–2 in. in height.

10. The labelling system of claim 8 wherein dimensions of said first label and said stacked labels are between 3–7 in. in width and 0.5–0.75 in. in height.

11. The labelling system of claim 8 wherein dimensions of said first label and said stacked labels are approximately 2 inches in width and 3 inches in height.

12. The labelling system of claim 1 wherein said recording medium structure comprises an audio cassette.

13. The labelling system of claim 12 wherein dimensions of said first label and said stacked labels are approximately 3 in. in width and 0.5 in. in height.

14. The labelling system of claim 1 wherein said recording medium structure comprises a compact disc.

15. The labelling system of claim 1 wherein said plurality of stacked labels comprises between 3 and 10 labels.

16. An improved diskette of the type comprising a magnetic recording disk contained within a protective cover, the improvement comprising:

a first label adhesively secured to said cover by a first adhesive covering an entire surface area of a bottom surface of said first label; and a plurality of stacked labels positioned over said first label, each of said stacked labels being removably adhered to an underlying label by a second adhesive covering an entire surface area of a bottom surface of each of said stacked labels, said second adhesive enabling each of said stacked labels to be peeled off an underlying label without adversely affecting said underlying label, wherein said stacked labels re positioned over said first label in a staggered fashion with one or more dimensions of each overlying label being smaller than corresponding dimensions of an underlying label.

17. An improved cassette of the type comprising magnetic tape contained within a housing, the improvement comprising:

a first label adhesively secured to said housing by a first adhesive covering an entire surface area of a bottom surface of said first label; and a plurality of stacked labels positioned over said first label, each of said stacked labels being removably adhered to an underlying label by a second adhesive covering an entire surface area of a bottom surface of each of said stacked labels, said second adhesive enabling each of said stacked labels to be peeled off an underlying label without adversely affecting said underlying label, wherein said stacked labels are positioned over said first label in a staggered fashion with one or more dimensions of each overlying label being smaller than corresponding dimensions of an underlying label.

18. A changeable labelling system comprising:

a first label adhesively secured to a recording medium structure container; and a plurality of stacked labels positioned over said first label, each of said stacked labels being removably adhered to an underlying label, wherein said first label is adhesively secured to said recording medium structure container by a first adhesive covering an entire surface area of a bottom surface of said first label, and each of said stacked labels are adhered to an underlying label by a second adhesive covering an entire surface area of a bottom surface of each of said stacked labels, said second adhesive enabling each of said stacked labels to be peeled off an underlying label without adversely affecting said underlying label, and wherein said stacked labels are positioned over said first label in a staggered fashion with one or more dimensions of each overlying label being smaller than corresponding dimensions of an underlying label.

19. A changeable labelling system comprising:

a first label having an adhesive covering an entire surface area of a bottom surface of said first label; and a plurality of stacked labels positioned over said first label, each of said stacked labels being removably adhered to an underlying label, wherein said stacked labels are positioned over said first label in a staggered fashion with one or more dimensions of each overlying label being smaller than corresponding dimensions of an underlying label.

* * * * *